United States Patent [19]

Regber et al.

[11] 4,030,418

[45] June 21, 1977

[54] GRAVITY DEPLOYED MINE WITH COMBINED UPPER CLEARING CHARGE FIRING AND DELAYED MAIN CHARGE INITIATION

[75] Inventors: Norman Regber, Rockaway; Ferdinando V. Dukic; Frank Diorio, both of Lake Hopatcong, all of N.J.

[73] Assignee: The United States of America as represented by the Secretary of the Army, Washington, D.C.

[22] Filed: Oct. 30, 1975

[21] Appl. No.: 627,176

[52] U.S. Cl. ..... 102/8; 102/19.2; 102/24 HC; 102/27 R; 102/70.2 R

[51] Int. Cl.[2] ..... F42B 21/00; F42B 23/26; F42B 1/02; F42B 3/10

[58] Field of Search ..... 102/8, 19.2, 24 HC, 102/56 SC, 70.2 R, 27 R; 200/225, 233, 235, 240, 241

[56] References Cited

UNITED STATES PATENTS

| | | | |
|---|---|---|---|
| 2,411,788 | 11/1946 | Hammond | 102/70.2 R |
| 2,706,949 | 4/1955 | Kessenich | 102/24 HC |
| 2,863,014 | 12/1958 | Deer | 200/225 |
| 3,086,468 | 4/1963 | Mountjoy | 102/70.2 R |
| 3,088,014 | 4/1963 | Stewart | 200/225 |
| 3,158,705 | 11/1964 | Bliss | 102/70.2 R |
| 3,292,536 | 12/1966 | Church | 102/24 HC |
| 3,495,532 | 2/1970 | Roberts | 102/24 HC |
| 3,557,697 | 1/1971 | Joyner | 102/2 |
| 3,875,862 | 4/1975 | Fischer | 102/56 SC |
| 3,956,988 | 5/1976 | Pecksen | 102/24 HC |

FOREIGN PATENTS OR APPLICATIONS

| | | | |
|---|---|---|---|
| 2,067,683 | 10/1969 | France | 102/56 SC |
| 2,071,271 | 9/1971 | France | 102/8 |
| 14,928 | 9/1892 | United Kingdom | 200/226 |

*Primary Examiner*—Samuel W. Engle
*Assistant Examiner*—Donald P. Walsh
*Attorney, Agent, or Firm*—Nathan Edelberg; A. Victor Erkkila; Thomas R. Webb

[57] ABSTRACT

A double-ended mine, adapted to be carried by a projectile, deployed by gravity, and come to rest on either end, comprises: a housing having two end walls and a connecting side wall; an annular main high explosive charge, lined on each end with a concave missile plate, in the housing; a clearing charge located between the main charge and each end wall; a fuze body mounted in the annular charge; an arming slider slidable in an axial channel in the body between safe and armed positions; a slider spring; two spin-released bolts in the body for locking the slider in safe position prior to projectile launch; a spring-biased pin for preventing rotation of the slider and for locking the slider in armed position; an electrical fast-fire detonator mounted in a first radial channel in the body; a first explosive lead mounted in a transverse passage in the slider in alignment with the detonator in armed position; a mechanical gravity-controlled switch and two combustible cords connecting the first explosive lead with the clearing charges; an electrical delay detonator mounted in a second radial channel in the fuze body; four radial channels in the slider aligned with four radial channels through the fuze body, an axial passage connecting the delay detonator to the aligned channels, in the armed position of the slider, and explosive leads in the aligned channels and axial passage, for initiating the main charge; and terminals for simultaneously applying an electrical firing signal from a proximity fuze to the two detonators, to first initiate the upper clearing charge only and thereby remove the upper end wall only and, after a predetermined delay time, initiate the main charge.

In a modification, the radial delay detonator is replaced by an axial delay element connected between the first explosive lead and the aligned radial channels and leads.

9 Claims, 8 Drawing Figures

GRAVITY DEPLOYED MINE WITH COMBINED UPPER CLEARING CHARGE FIRING AND DELAYED MAIN CHARGE INITIATION

In a modification, the radial delay detonator is replaced by an axial delay element connected between the first explosive lead and the aligned radial channels and leads.

GOVERNMENTAL INTEREST

GOVERNMENTAL INTEREST

GOVERNMENTAL INTEREST

The invention described herein may be manufactured, used and licensed by or for the Government for governmental purposes without the payment to me of any royalty thereon.

BACKGROUND AND SUMMARY OF THE INVENTION

The present invention relates to an improved, high-explosive, land mine containing a plurality of explosive charges, and improved fuze means for initiating the charges in a particular sequence, in response to a signal produced by the presence of a tank or other armored vehicle.

Bearce U.S. Pat. No. 3,216,354, granted Nov. 9, 1965, disclosed a land mine, intended to be placed underground, including a short cylindrical housing containing a main high explosive shaped charge having a lower flat surface and an upper dish-shaped surface which is lined with a metal plate or cover member of frangible or malleable material. An auxiliary clearing charge is carried by a removable top plate of the housing (above the shaped charge) together with a primer and an impact fuze mechanism adapted to be actuated by a vehicle to actuate the primer to initiate the clearing charge. Explosion of the clearing charge (1) blows the overburden and the top plate off the housing to expose the shaped charge, and (2) actuates a firing mechanism which initiates a delay charge which, after a predetermined time interval, initiates the lined shaped charge.

In a copending application of Allen E. Stern, Ser. No. 627,174, filed concurrently herewith assigned to the same assignee, the land mine of the Bearce patent is modified and improved by: (1) making it double-ended, with a concave surface on each end of the main charge lined with a hardened metal missile plate and a removable external end wall at each end of the housing, whereby the mine can be carried into the air by an artillery projectile, for example, ejected over the desired area, deployed from the air, and come to rest by gravity on either end thereof, instead of being placed underground; (2) positioning a clearing charge at each end, between the main charge and the end wall; and (3) providing means including a gravity-controlled switch for initiating the upper clearing charge only, and thereby removing the upper end wall only, in response to a firing signal, e.g. derived from a proximity fuze, prior to initiation of the main charge of the mine.

In Wolterman U.S. Pat. No. 3,891,162, granted June 24, 1975, a projectile, having a main charge and a supplemental charge, is provided with a fast firing train, including an elongated flash tube, for first initiating the supplemental charge, a slow firing train, including a delay element and a detonator radially aligned with an explosive lead in armed position, for subsequently initiating the main charge, and a single igniting means for simultaneously initiating the two firing trains. No means for interrupting and completing the fast firing train is provided.

An object of the present invention is to provide a new and improved fuze means for first initiating a supplemental explosive charge and then initiating the main charge in a high explosive land mine.

In accordance with the invention, a land mine containing a main high explosive charge and a suplemental explosive charge is provided with improved fuze means for initiating the supplemental charge and subsequently initiating the main charge after a predetermined delay, comprising: a fuze body containing a fast firing train connected to the supplemental charge, a slow firing train, including a delay element, connected to the main charge; an arming member slidable in the fuze body between a safe position and an armed position, at least a portion of each firing train being carried by the arming member in such manner that both firing trains are completed by the slider in its armed position only, and means for initiating the two firing trains substantially simultaneously in response to a single firing signal.

Preferably, the mine is aerially-deployed and double-ended, with a supplemental clearing charge at each end, as in the Stern application, and the fast firing train is selectively connected to the upper clearing charge only, by means of a gravity-controlled switch.

In one embodiment, the delay element is a delay detonator forming part of the slow firing train and initiated simultaneously with a fast-firing detonator in the fast firing train. In another embodiment, the slow firing train is initiated by the first firing train. Each embodiment includes a gravitycontrolled switch disclosed and claimed in a copending application of Ferdinando V. Dukic, one of the inventors of this application, Ser. No. 627,175, filed herewith, assigned to the same assignee.

DETAILED DESCRIPTION OF PREFERRED EMBODIMENTS

Figure 1:
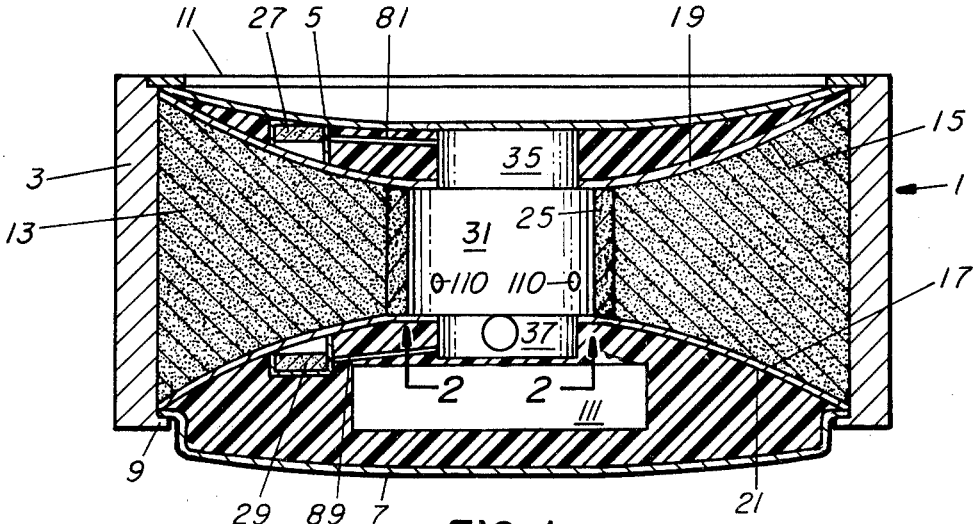
FIG. 1 is an axial section view of an explosive land mine incorporating one embodiment of the present invention.

FIG. 1 shows a land mine incorporating the basic structure of the double ended Stern mine, referred to above. The mine has a generally-cylindrical external metal housing 1 comprising a short cylindrical side wall 3 and two end walls 5 and 7 detachably secured to the side wall 3, near the ends thereof, by any suitable means, such as a flange 9 and a retaining ring 11, as shown. An annular main explosive charge 13, having concave end surfaces 15 and 17, is formed within the housing 1, as by casting. A pair of concave annular missile plates 19 and 21 are positioned on the concave end surfaces 15 and 17, to form a double-ended, Miznay-Schardin, or plate, charge. The central opening 23 in the main charge 13 is preferably lined with a tubular booster charge 25. Two clearing charges 27 and 29 of low explosive propellant material are located one at each end of the mine, between each plate 19 or 21 and the adjacent end wall 5 or 7, for explosively removing one end wall prior to initiation of the main charge 13.

The mine shown in FIG. 1 is adapted to be packed with other mines in a spin-launched projectile, ejected near the target area, deployed by gravity and come to rest on the ground lying on either end. The end walls 5 and 7 are preferably formed with similar curvatures in the same direction, as shown, in order to provide more space between the end wall 7 and plate 21 than that between end wall 5 and plate 21, for storing fuze components and accessories, and still permit close packing in the projectile.

Axially mounted within the booster charge 25 is a generally-cylindrical metal fuze body 31 having a central portion 33, coextensive with the booster charge 25, and two end portions 35 and 37 of smaller diameter extending through the openings in the annular plates 19 and 21. The fuze body 31 is shown in detail in FIGS. 2–6. Fuze body 31 has an axial bore or channel 39 in which a cylindrical metal arming slider 41 is slidable between a safe position shown in FIG. 3 and an armed position shown in FIGS. 4 and 5. The slider 41 has an L-shaped recess 43 into which a pin 45, biased inwardly by a spring 47, extends, to prevent rotation of the slider in the fuze body, and to lock the slider in the armed position.

Figure 3:
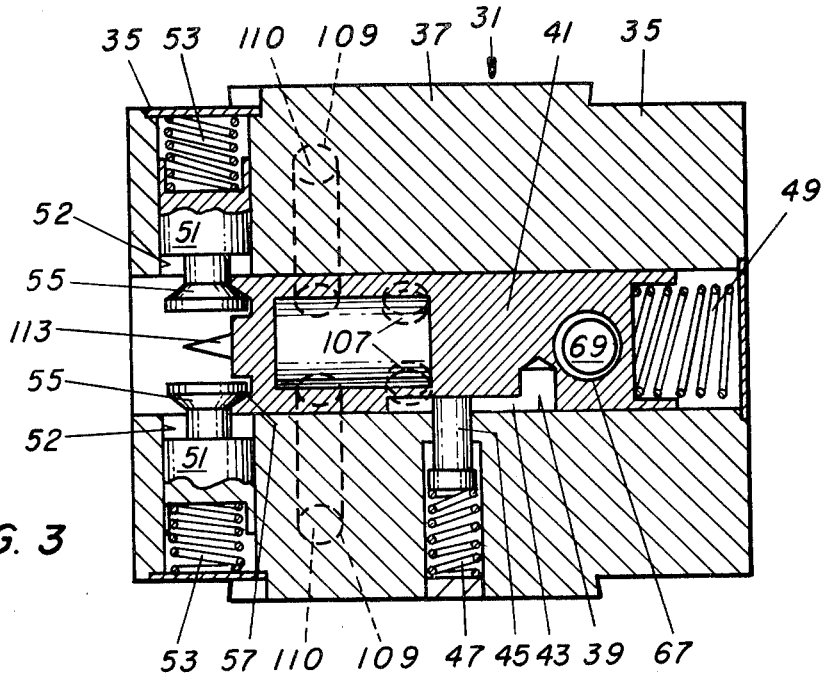
FIG. 3 is an axial section view of the fuze body, taken along line 3—3 of FIG. 2, with the slider in safe position.
Figure 4:
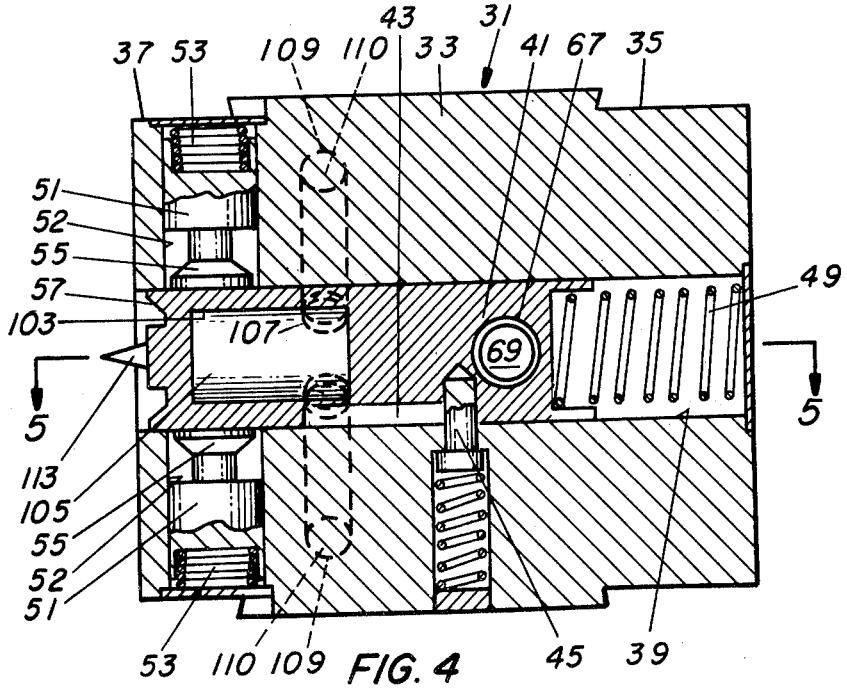
FIG. 4 is a view similar to FIG. 3, with the slider in armed position.

The slider 41 is locked in the safe position in FIG. 3, in opposition to a slider spring 49, by the inner ends of two locking bolts 51, slidable in radial bores 52 in the slider and biased inwardly by springs 53. Each bolt 51 has a beveled inner head 55 which engages in a beveled recess 57 in the front end of the slider 41, to prevent premature outward movement of the bolts 51.

Figure 5:
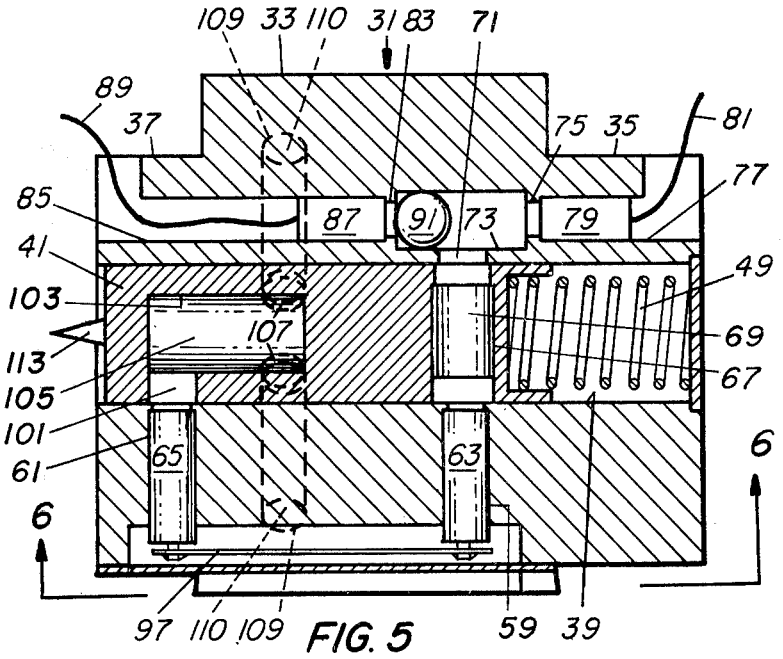
FIG. 5 is an axial section view of the fuze body, taken on line 5—5 of FIG. 4.
Figure 6:
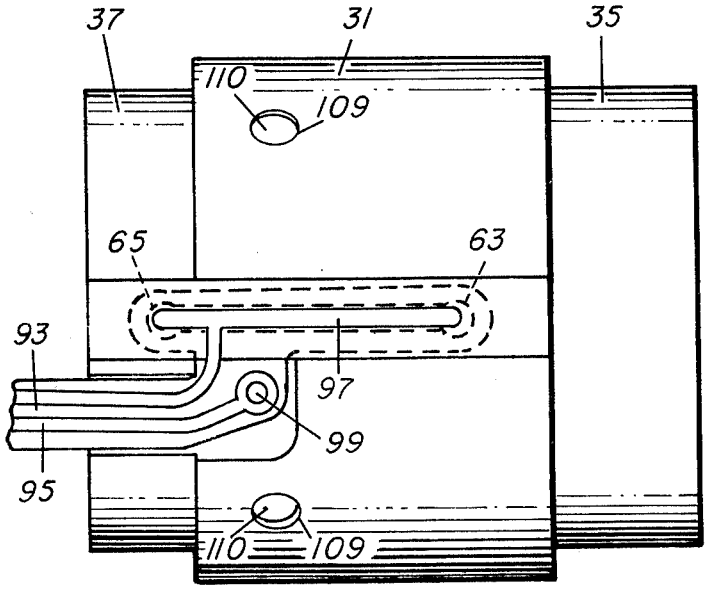
FIG. 6 is a bottom plan view of FIG. 5.

Referring to FIG. 5, the fuze body 31 has two parallel, radial bores or channels 59 and 61, in a plane normal to the plane of the bores 52, in which a fast-fire detonator 63 and a delay detonator 65, respectively, are mounted. In the armed position of the slider 41, the fast detonator 63 is aligned with one end of a transverse bore or passage 67 in the slider 41 containing an explosive lead 69. A short radial bore or channel 71 in slider 41, aligned with the opposite end of bore 67, opens into a cylindrical cavity 73 in fuze body 31 which extends parallel with the axis of the slider 41. The right-hand end of cavity 73 is connected, by a reduced diameter bore 75, to a channel 77 which opens through the end 37 and contains an acceptor element 79, which may be either combustible or explosive. Acceptor element 79 is connected by a combustible cord 81 to the clearing charge 27 located at that end of the mine (see FIG. 1). Similarly, the left-hand end of cavity 73 is connected, by a reduced bore 83, bore 85, acceptor element 87, similar to element 79, and combustible cord 89, to the clearing charge 29 located at the other end of the mine. A metal ball or sphere 91 is slidably mounted in cavity 73 and adapted to move by gravity to either end thereof, thereby exposing one acceptor element 79 or 87 to the explosive wave from lead 69 while closing the other end of the cavity 73. Thus, the elements 71 through 89 constitute a gravity-controlled switch connected between explosive lead 69 and the two clearing charges 27 and 29. This switch cavity 73 is oriented parallel to the axis of the mine in FIG. 1, whereby initiation of the detonator 63, after the mine has come to rest on one of its ends, automatically causes initiation of the upper clearing charge 27 or 29 only. The detonator 63, explosive lead 69 and connecting passages constitute a "fast firing train" connected, by the gravity-controlled switch, element 79 and cord 81, to the upper clearing charge 27, in the armed position of the slider 41.

In the example disclosed, the detonators 63 and 65 are electrically-initiated simultaneously by an electrical signal, obtained by any known sensing device (not shown), such as the magnetometer of Odom et al. U.S. Pat. No. 3,239,754, dated Mar. 8, 1966, responsive to the presence of an enemy tank, applied to the detonators, by means of two electrical leads 93 and 95. Lead 93 may be connected to one terminal of each of the two detonators by a busbar 97, and lead line 95 may be connected to the other terminals through ground 99 (fuze body 31).

Figure 2:
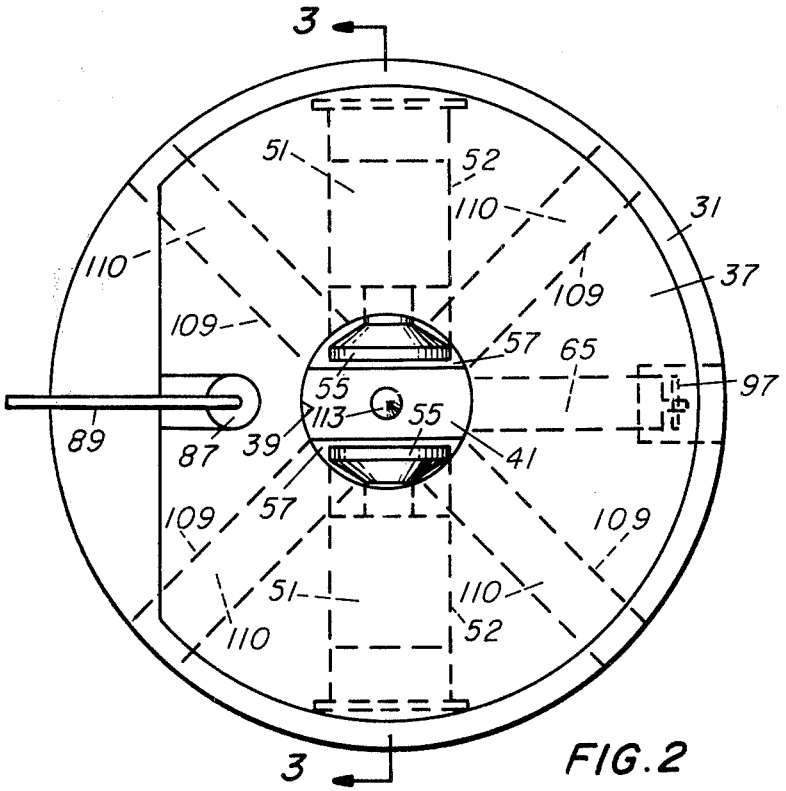
FIG. 2 is an end view of the fuze body of the mine of FIG. 1, taken in the direction 2—2.

In the armed position of the slider 41 in FIG. 5, the delay detonator 65, is aligned with a radial slider bore 101 which opens into the forward end of an axial passage 103 containing an explosive lead 105. The other end of passage 103 opens into a plurality of radial slider bores 107 (preferably four) which, in turn, are aligned with the same number of radial bores 109 extending through the fuze body 31 to the booster charge 25 (FIGS. 1 and 2). The bores contain explosive leads 110. Thus, when a signal is applied to busbar 97, the delay detonator 65 is initiated, and after a predetermined time, determined by the nature of the delay detonator, the explosive output of the delay detonator 65 is transmitted, through lead 105, bores 107 and leads 110, to the booster charge 25, which, in turn, initiates the main charge 13. The delay detonator 65, bore 101, lead 105, bores 107, and leads 110 constitute a "slow firing train" connected, by booster charge 25, to the main charge 13. The fuze body 31 and the parts carried thereby, including the combustible cords 81 and 89, constitute a "SAFE-AND-ARM" fuze for first initiating the upper clearing charge only and subsequently initiating the main charge of the mine.

Figure 7:
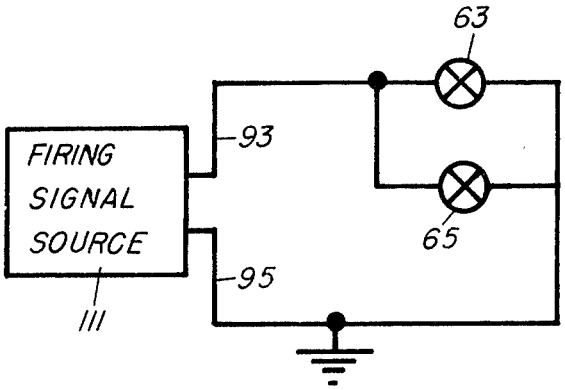
FIG. 7 is a firing circuit diagram.

The mine may be packed (with others) in a spin-launched projectile (not shown) with the mine axis coincident or parallel with the projectile axis, whereby the projectile imparts spin to the mine before ejection thereof. When the projectile is launched, the usual set-back force causes the mine slider 41 to move backward (to the right in FIG. 3), thus withdrawing the recesses 57 from the bolt heads 55. When thus released, the bolts 51 move outward by centrifugal force, due to the spin of the mine, thus releasing the slider 41 to be moved forward by its spring 49 to the armed position of FIGS. 4 and 5, where it is locked by spring-pressed pin 45. The rectangular box 111, in the space between the fuze body 31 and end wall 7 in FIG. 1, schematically represents a proximity fuze for sensing the presence of a nearby tank and applying an electrical signal to the leads 93 and 95. The electrical circuit of the detonators 63 and 65 and the fuze 111 is shown in FIG. 7. The proximity fuze 111 may include a battery (not shown) positioned near the adjacent end of the fuze body 31, in position to be energized by a striker point 113 on the front end of the slider 41 as it moves into armed position. Thus, the SAFE-AND-ARM fuze is armed and the proximity fuze is energized, ready to sense the presence of a nearby tank, before the mine reaches the ground. On the other hand, the proximity fuze is inoperative prior to arming of the SAFE-AND-ARM fuze.

Figure 8:
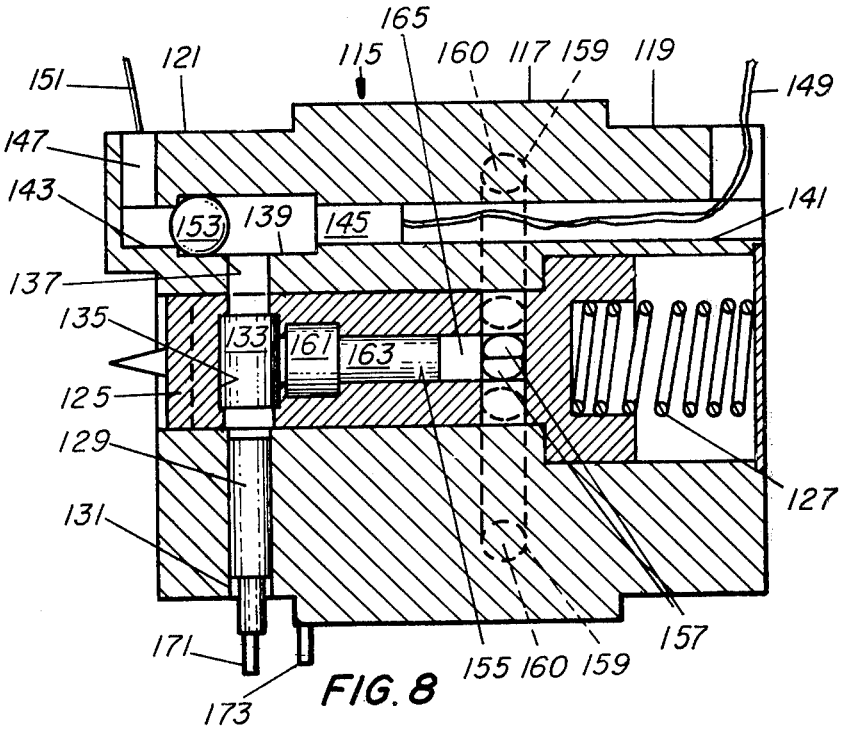
FIG. 8 is a view similar to FIG. 5, showing another embodiment of the invention.

FIG. 8 shows a modified SAFE-AND-ARM fuze having only one detonator. This fuze comprises a fuze body 115, including a central portion 117 and two smaller diameter end portions 119 and 121, and having an axial bore 123 containing a slider 125 and a slider spring 127. The slider is shown in armed position with the slider locked forward, as in FIG. 5. A fast-fire detonator 129 is mounted in a radial bore or channel 131 in fuze body portion 119, in alignment with one end of an explosive lead 133 mounted in a transverse slider bore or passage 135. A second radial bore or channel 137, aligned with the opposite end of lead 133, opens into the side of an elongated cylindrical cavity 139. The two ends of cavity 139 are connected, by reduced bores 141 and 143, explosive elements 145 and 147, and combustible cords 149 and 151, to the two clearing charges 27 and 29. A spherical ball 153 in cavity 139 completes a gravity-controlled switch, as in FIG. 5. The fast detonator 129 and lead 133 constitutes a "fast firing train", as in FIGS. 1–6. Slider 125 has an axial bore or passage 155 which opens at one end into bore 135 and at the other end into four radial bores 157 (two shown), which, in turn, are aligned with four radial bores or channels 159 (two shown) in the fuze body 115. The explosive lead 133 is connected to the booster charge 25 (FIG. 1) by an explosive lead 161, delay element 163 and explosive lead 165 in bore 155, and the aligned bores 157 and 159. Bores 159 contain explosive leads 160. The lead 161, delay element 163, lead 165, bores 157 and leads 160 constitute a slow firing train connected between lead 133 and the main charge 13.

The operation of the fuze in FIG. 7 is similar to that in FIGS. 1–6. An electrical signal applied to terminals 171 and 173, connected to the detonator 129 and to ground, respectively, initiates the lead 133 which, in turn, initiates lead 161 and the upper clearing charge 27 or 29 substantially simultaneously. The lead 161 starts the delay of delay element 163, which eventually initiates the remainder of the firing train made up of lead 165, bores 157 and leads 160, to initiate the booster charge 25 and main charge 131.

The foregoing disclosure and the drawings are merely illustrative of the principles of this invention and are not to be interpreted in a limiting sense. We wish it to be understood that we do not desire to be limited to the exact details of construction shown and described, because obvious modifications will occur to a person skilled in the art.

What is claimed is:

1. In a high-explosive land mine comprising a housing containing a high-explosive main charge, a separate supplemental explosive charge, and fuze means for first initiating said supplemental charge and then, after a predetermined delay time, initiating said main charge; said fuze means comprising:

a fuze body containing a fast firing train connected to said supplemental charge, and a slow firing train, including a delay element, connected to said main charge;

an arming member, slidable in said fuze body between a safe position and an armed position, at least a portion of each firing train carried by said arming member, both firing trains being completed by said arming member in its armed position only; and means for initiating said firing trains substantially simultaneously, in response to a single firing signal.

2. In a mine as in claim 1, adapted to be carried by a spin-launched projectile and ejected therefrom during flight, said fuze means further comprising spin-releasable means for preventing movement of said slider from said safe position to said armed position prior to launch of the projectile.

3. Fuze means as in claim 1, wherein said delay element is a delay detonator, and said means includes means for simultaneously initiating said detonators.

4. Fuze means as in claim 1, wherein said slow firing train is initiated by said fast firing train.

5. In a double-ended high-explosive anti-tank land mine, adapted to be deployed by gravity and come to rest on either end, comprising: a housing having two opposite external end walls and a connecting side wall; a main high-explosive charge in said housing; a separate clearing charge interposed between said main charge and each of said end walls; and fuze means for first initiating the upper clearing charge only, to remove the upper end wall and expose the main charge, and, after a predetermined delay time, initiating said main charge; said fuze means comprising:

a fuze body containing a fast firing train and means including a gravity-controlled switch for connecting said first firing train with the upper clearing charge only, after said mine has come to rest, and a slow firing train, including a delay element, connected to said main charge;

an arming member, slidable in said fuze body between a safe position and an armed position, at least a portion of each firing train carried by said arming member, both firing trains being completed by said arming member in its armed position only; and means for initiating said firing trains substantially simultaneously, in response to a single firing signal.

6. Fuze means as in claim 5, wherein said delay element is a delay detonator, and said means includes means for simultaneous initiating said detonators.

7. Fuze means as in claim 6, wherein:

said fuze body has an elongated main channel therein and at least four radial channels therethrough, each opening into said main channel, the first and second radial channels being aligned on opposite sides of said main channel, the first radial channel containing a fast-fire detonator, the second radial channel being connected to said switch, the third radial channel containing said delay detonator, and the fourth radial channel containing a portion of said slow firing train;

said arming member is slidable in said main channel, has a transverse passage therethrough in alignment with said first and second radial channels in said armed position and containing an explosive lead forming part of said fast firing train, and has a second passage therein containing a second explosive lead and connecting said third and fourth radial channels in said armed position.

8. Fuze means as in claim 5, wherein said slow firing train is initiated by said fast firing train.

9. Fuze means as in claim 8, wherein:

said fuze body has an elongated main channel therein and at least three radial channels therethrough, each opening into said main channel, the first and second radial channels being aligned on opposite sides of said main channel, the first radial channel containing a fast-fire detonator, the second radial channel being connected to said switch, the third radial channel containing a portion of said slow firing train;

said arming member is slidable in said main channel, has a transverse passage therethrough in alignment with said first and second radial channels in said armed position and containing an explosive lead forming part of said fast firing train, and has a second passage therein containing said delay element and a second explosive lead and connecting said third and fourth radial channels in said armed position.

* * * * *